US008856974B2

(12) United States Patent
Lanez et al.

(10) Patent No.: US 8,856,974 B2
(45) Date of Patent: Oct. 14, 2014

(54) SAFETY HELMET WITH IMPROVED ADJUSTMENT

(75) Inventors: Raphael Lanez, Crolles (FR); Alain Maurice, Saint Hilaire du Touvet (FR)

(73) Assignee: Zedel, Crolles (FR)

( * ) Notice: Subject to any disclaimer, the term of this patent is extended or adjusted under 35 U.S.C. 154(b) by 551 days.

(21) Appl. No.: 13/108,492

(22) Filed: May 16, 2011

(65) Prior Publication Data

US 2011/0289659 A1 Dec. 1, 2011

(30) Foreign Application Priority Data

May 27, 2010 (FR) ..... 10 02249

(51) Int. Cl.
*A42B 1/22* (2006.01)
*A42B 3/14* (2006.01)

(52) U.S. Cl.
CPC ..... *A42B 3/145* (2013.01)
USPC ..... 2/417; 2/410; 2/418

(58) Field of Classification Search
CPC ..... A42B 3/145
USPC ..... 2/418, 195.1–195.4, 417, 419, 183, 2/426, 420, 421, DIG. 11; 24/68 B, 68 R, 24/68 SK, 70 ST, 69 ST; 74/530; 36/50.1, 36/119
See application file for complete search history.

(56) References Cited

U.S. PATENT DOCUMENTS

| | | | | |
|---|---|---|---|---|
| 3,729,779 | A * | 5/1973 | Porth | 24/68 SK |
| 5,373,588 | A | 12/1994 | Hede et al. | |
| 5,600,874 | A * | 2/1997 | Jungkind | 24/68 SK |
| 2010/0050325 | A1 | 3/2010 | Wang-Lee | |

FOREIGN PATENT DOCUMENTS

FR EP 0 558 427 A1 9/1993

* cited by examiner

*Primary Examiner* — Danny Worrell
*Assistant Examiner* — Khaled Annis
(74) *Attorney, Agent, or Firm* — Oliff PLC

(57) ABSTRACT

A safety helmet comprising an outer shell, an internal headband composed of a neckband at the rear and a securing strap at the front, and an adjustment mechanism of the headband. The adjustment mechanism comprises a double cog-wheel having a first sprocket associated with a first drive rack of the neckband, and a second sprocket associated with a second drive rack of the strap. The two sprockets have different diameters to perform differential driving of the strap and of the neckband.

4 Claims, 5 Drawing Sheets

SAFETY HELMET WITH IMPROVED ADJUSTMENT

The disclosure of French Patent Application No. 1002249 filed on May 27, 2010 including the specification, drawings and abstract is incorporated herein by reference in its entirety.

BACKGROUND OF THE INVENTION

The invention relates to a safety helmet comprising:

an outer shell in the form of a crown made from shock-resistant plastic material, a headband arranged inside the crown and composed of a neckband at the rear and a securing strap at the front, an adjustment mechanism provided with at least one rotary adjustment knob to adjust the headband to the size of the user's head, and a latch designed to occupy a latched position or an unlatched position to respectively prevent and allow driving of the knob in rotation.

STATE OF THE ART

The document EP 558427 filed by the applicant describes a safety helmet adjustable by means of a first knob commanding a double racking mechanism for adjustment of the headband. A second knob, situated on the side of the helmet, is associated with another racking system for adjustment of the neckband. The headband is formed by a flexible annular strip that grips the whole circumference of the head snugly following the internal configuration of the base of the crown. The neckband is formed by a protruding strap placed underneath the rear portion of the headband, outside the crown. Centering of the helmet on the user's head can however vary according to the different head sizes, and tightening of the neckband requires an additional adjustment.

OBJECT OF THE INVENTION

The object of the invention consists in providing a safety helmet equipped with an adjustment system by means of a knob that is precise, easy to execute for optimum comfort, and that at the same time keeps the desired adjustment position and centering on the head stable.

The helmet according to the invention is characterized in that the adjustment mechanism comprises a double cog-wheel having a first sprocket associated with a first drive rack of the neckband, and a second sprocket associated with a second drive rack of the strap, the two sprockets having different diameters to achieve differential driving of the strap and of the neckband.

Adjustment is performed after the helmet has been fitted on the head by the user using his two thumbs which perform both unlatching and driving in rotation of the two knobs. When the required adjustment has been attained, releasing the knob results in the latch automatically returning to the latched position. This adjustment is easy and quick while at the same time keeping centering of the helmet on the head, regardless of the adjustment position of the knob between the maximum and minimum tightening positions of the headband.

According to a preferred embodiment, the double cog-wheel and the corresponding control knob are fitted on each of the two sides around a common axis of rotation extending perpendicularly to the inner surface of the shell. The first sprocket of the double cog-wheel presents a larger diameter than that of the second sprocket.

According to one feature of the invention, the latch is actuated to the unlatched position by a thrust exerted manually on the control knob before the double cog-wheel is driven in rotation.

BRIEF DESCRIPTION OF THE DRAWINGS

Other advantages and features will become more clearly apparent from the following description of an embodiment of the invention given for non-example purposes only and represented in the appended drawings in which.

DETAILED DESCRIPTION OF THE INVENTION

Figure 1:
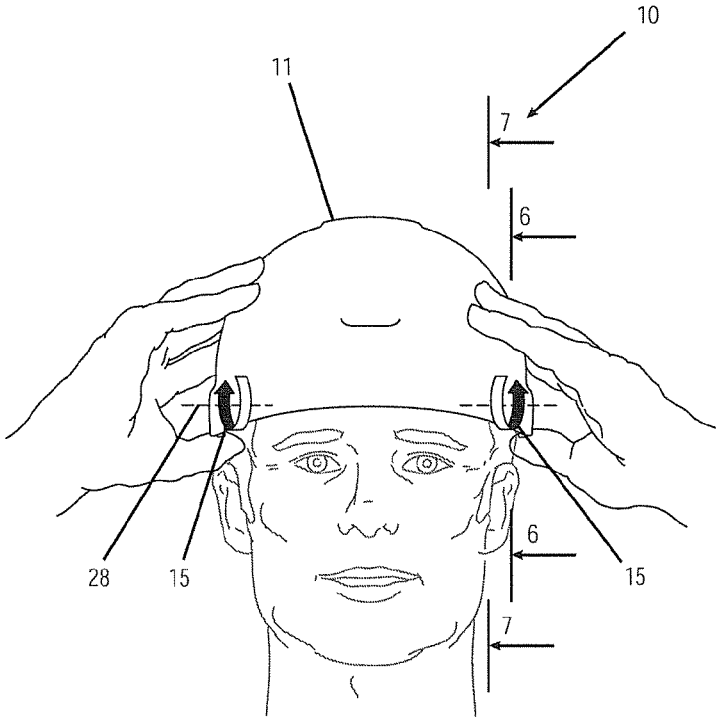
FIG. 1 is a front view illustrating the adjustment phase of the helmet on the user's head.

In the figures, a safety helmet 10 comprises an outer shell 11 in the form of a crown, equipped on the inside with a headband 12 adjustable to the user's head 12*a*. Shell 11 is made from a thermoplastic material able to absorb external shocks, in particular in case of rocks or ice falling. The headband 12 is composed of a neckband 13 at the rear AR, and a securing strap 14 at the front AV. The fixing system by a chinstrap is conventional and is not represented in the drawings.

An adjustment mechanism 15 is arranged on each side of shell 11 and is actuated by a rotary knob 16 to adjust headband 12 to the user's head size. The two adjustment mechanisms 15 are identical and are housed in enclosures 26 arranged symmetrically with respect to the mid-plane of plot XY (FIG. 2), A single adjustment mechanism 15 will be described in the following.

Each knob 16 is coupled with a double cog-wheel 17 composed of a first sprocket 18 engaging with a first drive rack 19 of neckband 13 and of a second sprocket 20 engaging with a second drive rack 21 of strap 14. Rotation of the two knobs 16 in one direction or the other causes a relative tightening or loosening movement of neckband 13 and of strap 14 on the head.

First rack 19 extends along a transmission lever 22, having a circular opening 23 articulated at one of the ends 24*a* of neckband 13. The other end 24*b* of the latter is articulated on the transmission lever of the other adjustment mechanism situated on the opposite side.

Second rack 21 is securedly affixed to a drive member 25 attached to one of the ends of strap 14. The other end is connected in similar manner to the drive member of the opposite adjustment mechanism.

Figure 2:
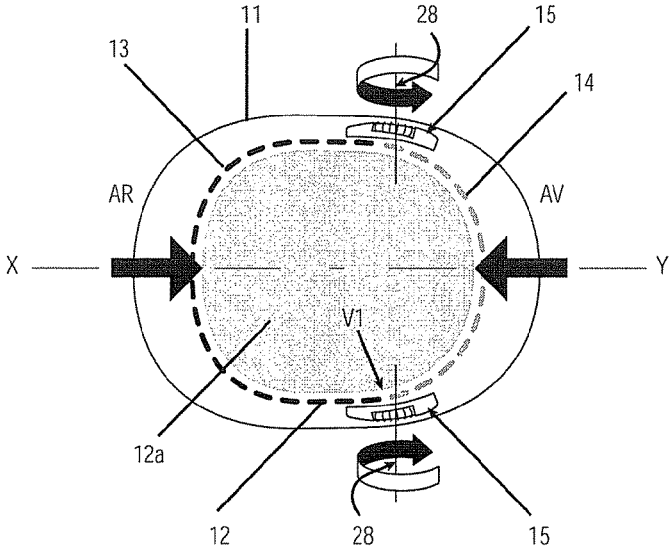
FIG. 2 shows a schematic view of the inside of the helmet with the headband surrounding the user's head.
Figure 3:
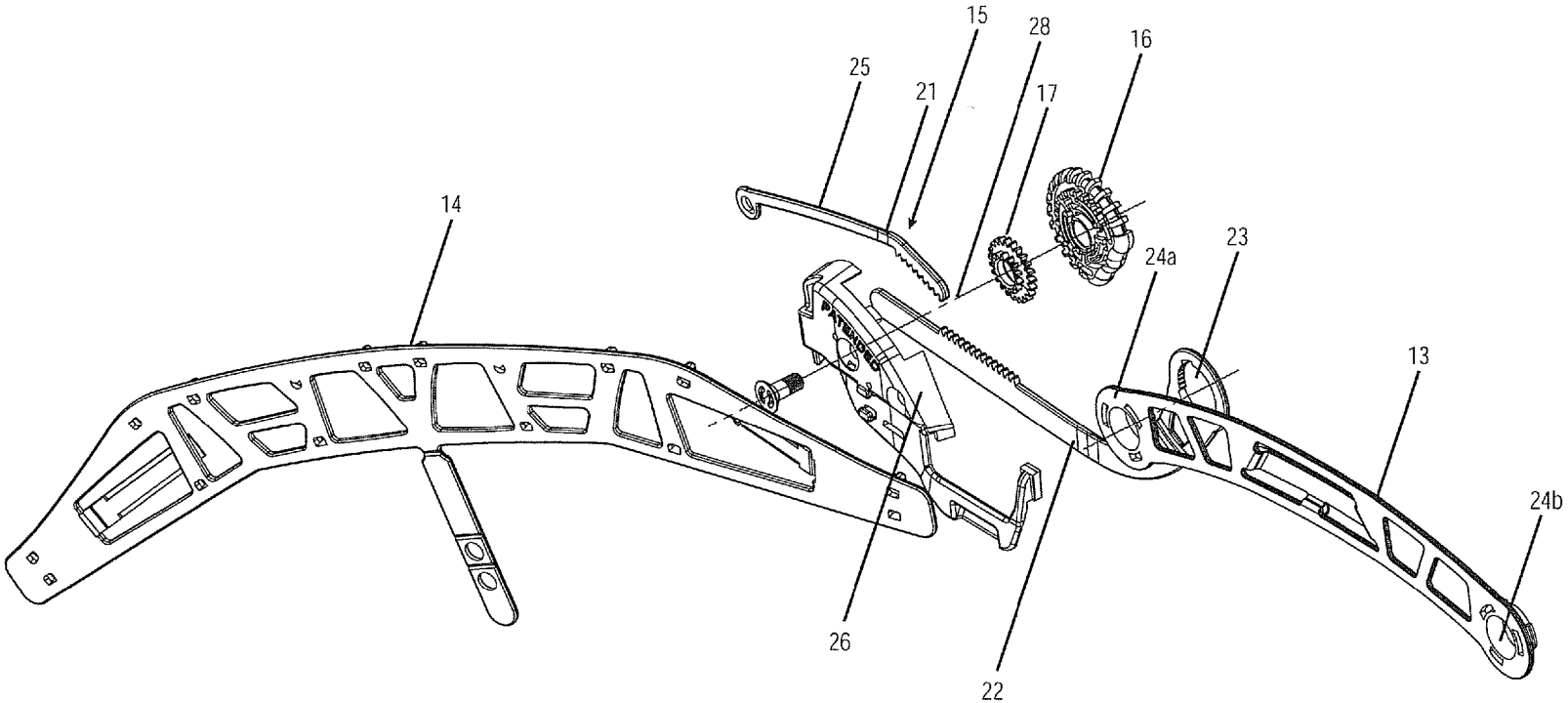
FIG. 3 represents an exploded perspective view according to the arrow V1 of FIG. 2 of an adjustment mechanism of the neckband and of the headband strap.
Figure 4:
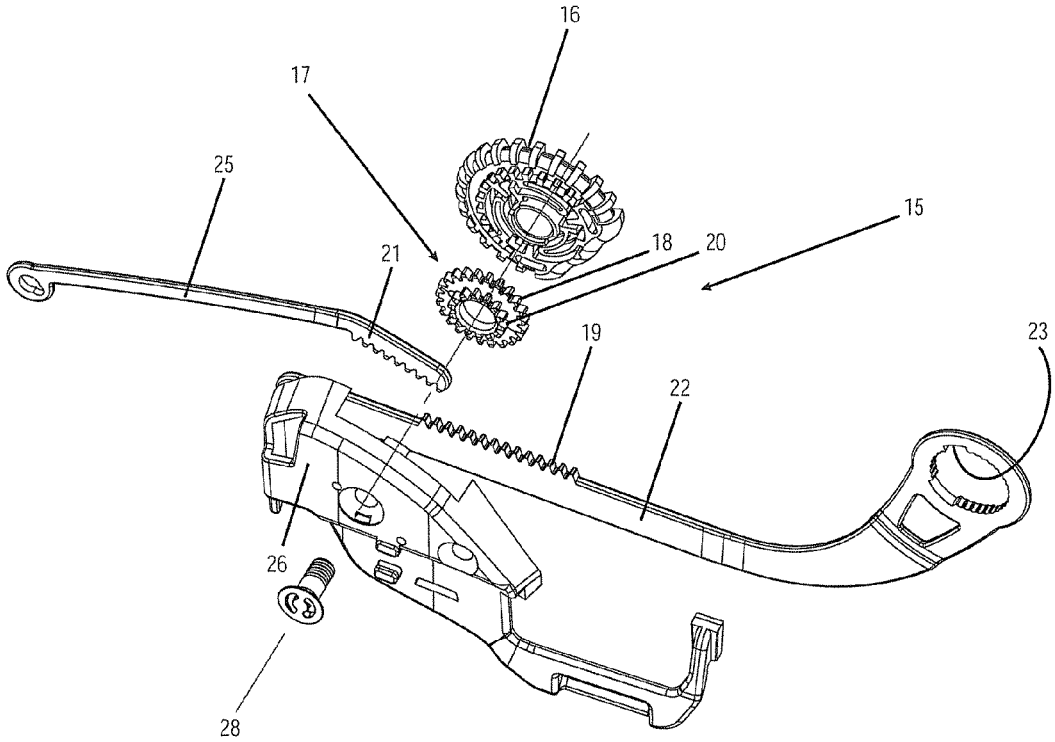
FIG. 4 shows the adjustment mechanism of FIG. 3, without the neckband and without the strap.

First sprocket 18 of double cog-wheel 17 presents a larger diameter than that of second sprocket 20 wherein the first sprocket 18 and the second sprocket 20 of the double-cog wheel 17 are fitted coaxial[y on the same axis on each side of the helmet as shown in FIGS. 1, 2 and 4. This results in differential movement of transmission lever 22 and of drive member 25 when rotation of knob 16 takes place. The assembly is arranged so as to preserve centering of the helmet on the users head, regardless of the adjustment position between the maximum and minimum tightening positions of headband 12.

Figure 5:
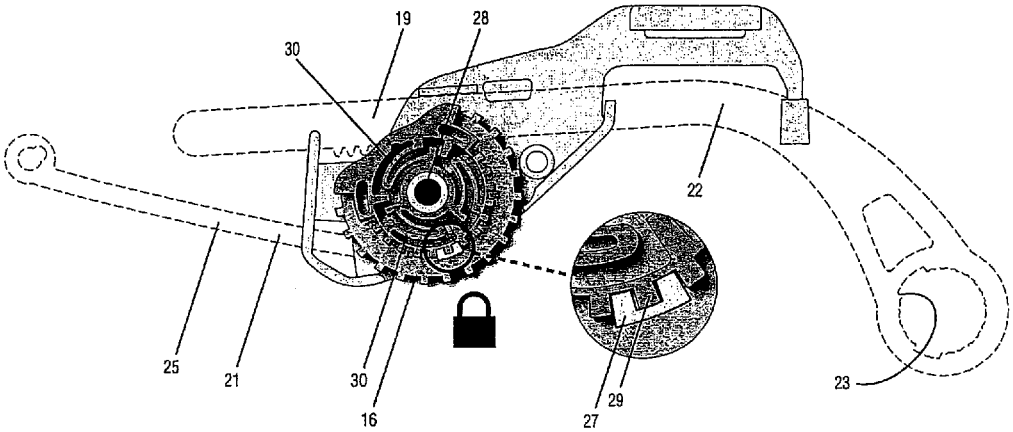
FIGS. 5 and 6 are cross-sectional views along the line 6-6 of FIG. 1 showing the inside of the knob with the latch respectively in the latched position and in the unlatched position.
Figure 6:
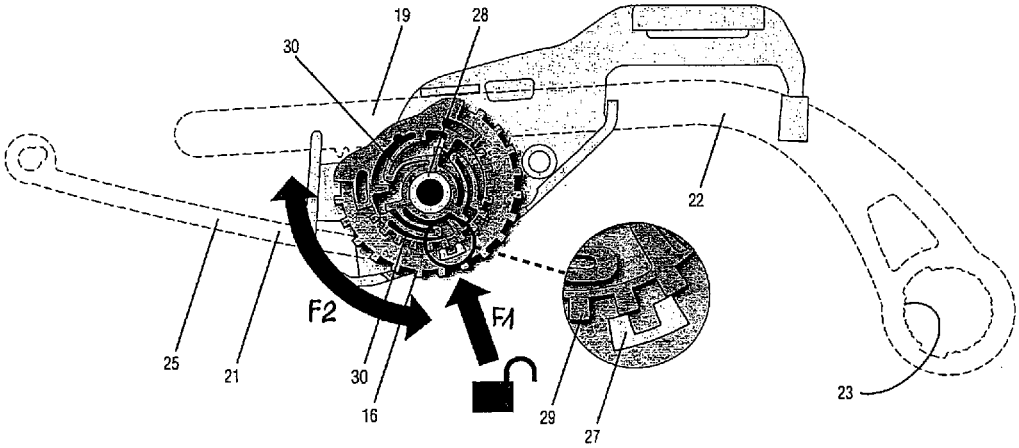
Figure 7:
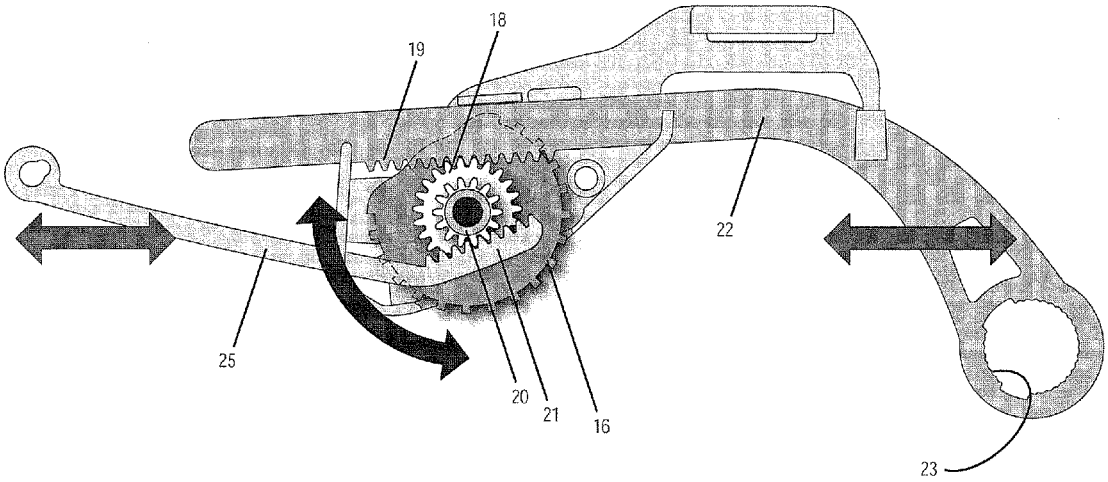
FIG. 7 is a cross-sectional view along the line 7-7 of FIG. 1 representing the double cog-wheel engaged with the transmission lever and the driving member.

Each adjustment mechanism 15 further comprises a latch 27 able to occupy a latched position (FIG. 5) or an unlatched position (FIG. 6) to respectively prevent or allow driving of knob 16 and double cog-wheel 17 in rotation. Knob 16 is fitted with double cog-wheel 17 on the same axis 28 and has an internal toothing 29 designed to operate in conjunction with latch 27. The axis 28 of rotation extends in a direction substantially perpendicular to the internal surface of shell 11.

Toothing 29 is connected to axis 28 by flexible tabs 30 acting as return spring biasing toothing 29 to engagement with latch 27 in the latched position of knob 16. Movement to the unlatched position is achieved by exerting an upward radial thrust force (arrow F1, FIG. 6) on knob 16. Tabs 30 deform by elasticity and toothing 29 is released after latch 27 has moved away. It is then possible to turn knob 16 (arrow F2) to the required adjustment position of headband 12.

Operation of the adjustment system is implemented in the following manner:

Adjustment of the helmet is performed after the latter has been placed on head 12*a* by the user using both hands (FIG. 1). The thumb acts on knob 16 while the other fingers of each hand keep the helmet in place.

The thumb first causes radial movement of knob 16 to actuate latch 27 to the unlatched position. The released knob 16 can then be turned in either direction to adjust headband 12 to the size of head 12*a*. When the desired adjustment has been achieved, pushing of the thumb on knob 16 simply has to be released and the latter is automatically immobilized in rotation by latch 27 returning to the latched position.

FIG. 2 shows centering of the helmet on the users head 12*a*, independently from rotation of adjustment mechanisms 15 between the maximum and minimum tightening positions of headband 12.

The invention claimed is:

1. A safety helmet comprising:

an outer shell in the form of a crown made from shock-resistant plastic material, a headband arranged inside the crown and composed of a neckband at the rear and a securing strap at the front, an adjustment mechanism provided with at least one rotary adjustment knob to adjust the headband to the size of the user's head, and a latch designed to occupy a latched position or an unlatched position to respectively prevent and allow driving of the knob in rotation, wherein the adjustment mechanism comprises a first double cog-wheel and a second double cog-wheel, wherein the first double cog-wheel has a first sprocket associated with a first drive rack of the neckband, and a second sprocket associated with a first drive rack of the strap, the first and second sprockets of the first double-cog wheel having different diameters to achieve differential driving of the strap and of the neckband, wherein the second double cog-wheel has a first sprocket associated with a second drive rack of the neckband, and a second sprocket associated with a second drive rack of the strap, the first and second sprockets of the second double-cog wheel having different diameters to achieve differential driving of the strap and of the neckband, wherein either one of the first and second double cog-wheels and corresponding control knob are fitted on each of the two sides around a common axis of rotation extending perpendicularly to the internal surface of the shell, and wherein the first and second sprockets of the first and second double-cog wheels are fitted coaxially on the same axis.

2. The safety helmet according to claim 1, wherein the latch is actuated to the unlatched position by a thrust exerted manually on the control knob before either one of the first and second double cog-wheels is driven in rotation.

3. The safety helmet according to claim 2, wherein the latch is biased to the latched position by return means, which are formed by at least one tab elastically deformable when a pushing action actuates the control knob.

4. The safety helmet according to claim 1, wherein the first sprocket of the first and second double cog-wheels presents a larger diameter than that of the second sprocket, the assembly being arranged to preserve centring of the helmet on the head, regardless of the adjustment position of the knob between the maximum and minimum tightening positions of the headband.

* * * * *